US011587438B2

(12) United States Patent
Nishimura et al.

(10) Patent No.: US 11,587,438 B2
(45) Date of Patent: Feb. 21, 2023

(54) CONTROL APPARATUS AND METHOD FOR CAUSING LIGHT DEMITTING DEVICES TO DISPLAY CROSSWALK

(71) Applicant: TOYOTA JIDOSHA KABUSHIKI KAISHA, Toyota (JP)

(72) Inventors: Kazuya Nishimura, Anjo (JP); Shin Sakurada, Toyota (JP); Soutaro Kaneko, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/550,626

(22) Filed: Dec. 14, 2021

(65) Prior Publication Data

US 2022/0254252 A1 Aug. 11, 2022

(30) Foreign Application Priority Data

Feb. 5, 2021 (JP) ..... JP2021-017773

(51) Int. Cl.
*G08G 1/07* (2006.01)
*G08G 1/052* (2006.01)
*G08G 1/005* (2006.01)

(52) U.S. Cl.
CPC ..... *G08G 1/07* (2013.01); *G08G 1/005* (2013.01); *G08G 1/052* (2013.01)

(58) Field of Classification Search
CPC ..... G08G 1/07; G08G 1/005; G08G 1/052
See application file for complete search history.

(56) References Cited

U.S. PATENT DOCUMENTS 6,384,742 B1 * 5/2002 Harrison ..... E01F 9/559 340/925
7,688,222 B2 * 3/2010 Peddie ..... G08G 1/096783 116/63 P
7,859,431 B2 * 12/2010 Peddie ..... G08G 1/096783 340/907
9,652,981 B2 * 5/2017 Liu ..... G06Q 50/265
9,976,714 B2 * 5/2018 Geisler ..... F21V 23/0407
10,002,536 B2 * 6/2018 Kim ..... H04W 52/0229
11,355,006 B1 * 6/2022 Cho ..... G08G 1/166
2005/0104747 A1 * 5/2005 Silic ..... G08G 1/005 340/944
2005/0270175 A1 * 12/2005 Peddie ..... G08G 1/096783 246/473 R
2009/0256723 A1 * 10/2009 Peddie ..... E01F 9/559 340/907

(Continued)

FOREIGN PATENT DOCUMENTS

JP 2014-225151 A 12/2014

*Primary Examiner* — Hoi C Lau
(74) *Attorney, Agent, or Firm* — Oliff PLC

(57) ABSTRACT

A control apparatus is a control apparatus for causing light emitting devices to display a crosswalk when the control apparatus detects a pedestrian who is about to cross a road. The control apparatus includes a controlling portion configured to perform: detect, as a first vehicle, a vehicle traveling in a crosswalk display region where a crosswalk is to be displayed; determine whether or not the speed of the first vehicle is less than a reference speed; and in a case where the speed is less than the reference speed and a predetermined safety standard is satisfied, determine to cause the light emitting devices to display the crosswalk.

12 Claims, 11 Drawing Sheets

(56) References Cited

U.S. PATENT DOCUMENTS

| | | | | |
|---|---|---|---|---|
| 2016/0366543 | A1* | 12/2016 | Berry | H04W 40/02 |
| 2017/0005717 | A1* | 1/2017 | Berry | H04W 36/32 |
| 2017/0018187 | A1* | 1/2017 | Kim | H04W 52/0229 |
| 2017/0030538 | A1* | 2/2017 | Geisler | F21V 23/0407 |
| 2017/0038018 | A1* | 2/2017 | Johnson | F21V 21/14 |
| 2017/0288722 | A1* | 10/2017 | Berry | H04W 4/44 |
| 2017/0289821 | A1* | 10/2017 | Berry | G01S 13/92 |
| 2022/0012988 | A1* | 1/2022 | Avadhanam | G06N 3/08 |
| 2022/0254252 | A1* | 8/2022 | Nishimura | G08G 1/07 |

* cited by examiner

CONTROL APPARATUS AND METHOD FOR CAUSING LIGHT DEMITTING DEVICES TO DISPLAY CROSSWALK

CROSS-REFERENCE TO RELATED APPLICATION

This application claims priority to Japanese Patent Application No. 2021-017773 filed on Feb. 5, 2021, incorporated herein by reference in its entirety.

BACKGROUND

1. Technical Field

This disclosure relates to a control apparatus and a method for causing light demitting devices to display a crosswalk.

2. Description of Related Art

In the related art, there has been known a technology to, when a pedestrian starts to cross a road, notify neighboring vehicles of the presence of the pedestrian. For example, Japanese Unexamined Patent Application Publication No. 2014-225151 (JP 2014-225151 A) describes a technology to transmit a stop request signal to a vehicle approaching a road determined to have a possibility that a pedestrian might cross the road.

SUMMARY

There is room for improvement in safety for road crossing as well as improvement in convenience for pedestrians by displaying a crosswalk even in a case where a line of vehicles does not move.

An object of this disclosure is to improve convenience for pedestrians and safety for pedestrians during road crossing.

A control apparatus according to the disclosure is a control apparatus for causing light emitting devices to display a crosswalk when the control apparatus detects a pedestrian who is about to cross a road. The control apparatus includes a controlling portion configured to: detect, as a first vehicle, a vehicle traveling in a crosswalk display region where the crosswalk is to be displayed; determine whether or not a speed of the first vehicle is less than a reference speed; and in a case where the speed is less than the reference speed and a predetermined safety standard is satisfied, determine to cause the light emitting devices to display the crosswalk.

A method according to the disclosure is a method to be executed by a control apparatus for causing light emitting devices to display a crosswalk when the control apparatus detects a pedestrian who is about to cross a road. The method includes: detecting, as a first vehicle, a vehicle traveling in a crosswalk display region where the crosswalk is to be displayed; determining whether or not a speed of the first vehicle is less than a reference speed; and in a case where the speed is less than the reference speed and a predetermined safety standard is satisfied, determining to cause the light emitting devices to display the crosswalk.

With this disclosure, it is possible to improve convenience for pedestrians and safety for pedestrians during road crossing.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Figure 1:
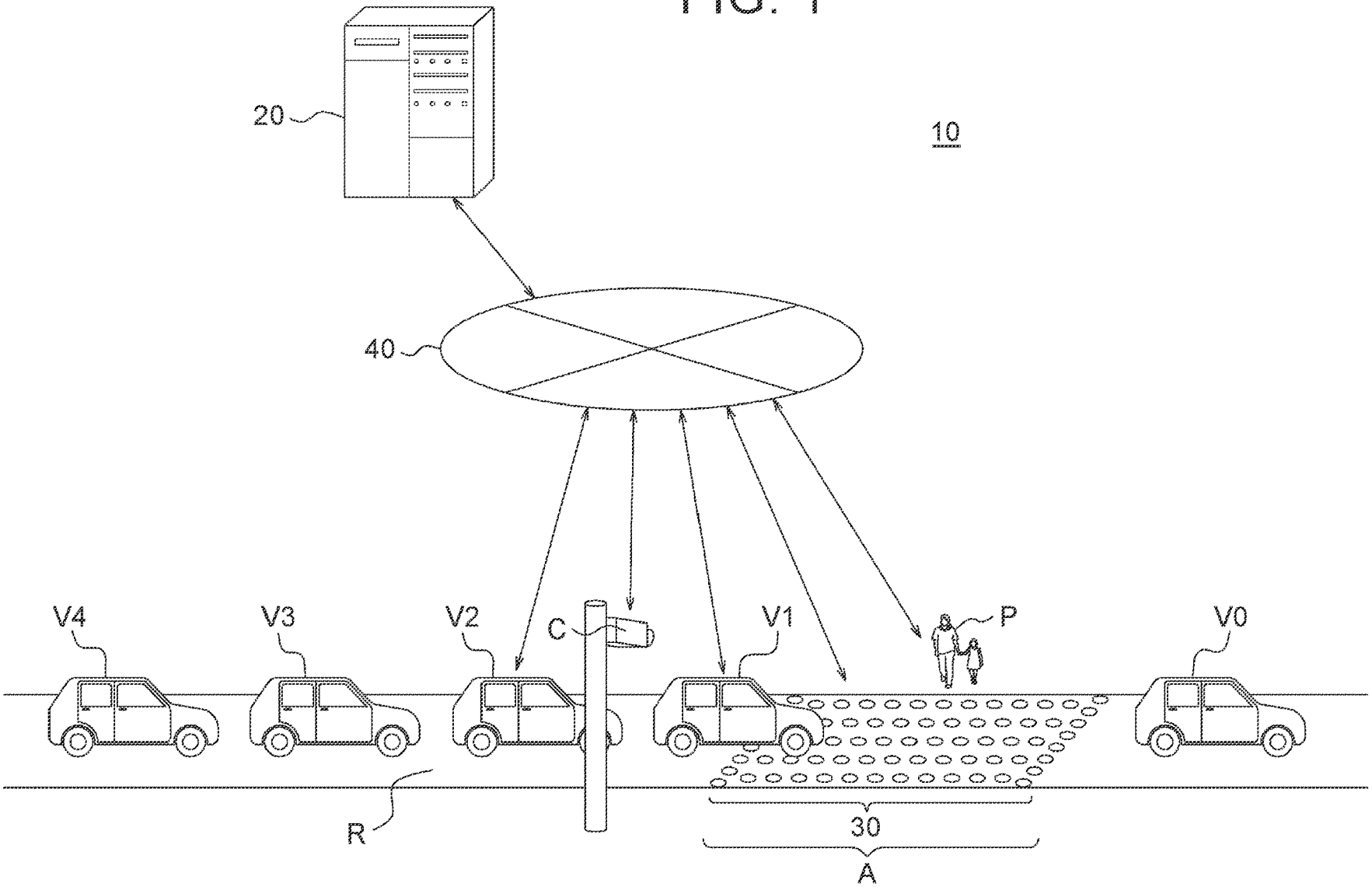
FIG. 1 is a view illustrating a configuration of a system according to the present embodiment.

The following will describe an embodiment of this disclosure with reference to the drawings. The same or equivalent portions in the drawings have the same reference sign. In the following description of the present embodiment, descriptions of the same or equivalent portions are omitted or simplified appropriately.

With reference to FIG. 1, the following describes the configuration of a system 10 according to the present embodiment.

The system 10 according to the present embodiment includes a control apparatus 20 and one or more light emitting devices 30. The control apparatus 20 can communicate with the light emitting devices 30 via a network 40.

The network 40 includes at least one WAN, at least one MAN, or a combination thereof. The "WAN" is an abbreviation of Wide Area Network. The "MAN" is an abbreviation of Metropolitan Area Network. The network 40 may include at least one wireless network, at least one optical network, or a combination thereof. The wireless network is, for example, an ad-hoc network, a cellular network, a wireless LAN, a satellite communications network, or a terrestrial microwave network. The "LAN" is an abbreviation of Local Area Network.

The control apparatus 20 may be provided in a facility such as a data center. The control apparatus 20 may be a server belonging to a cloud computing system or other computing systems, for example.

The light emitting devices 30 each have a communication function and a light emission function by a light emitting element, and the light emitting devices 30 are provided in a road. The light emitting devices 30 are controlled by the control apparatus 20 such that the light emitting devices 30 can independently turn on and off their light emitting elements. A given set of light emitting devices 30 are selected from the light emitting devices 30 and controlled such that the light emitting devices 30 in the given set are turned on. Hereby, the light emitting devices 30 can be turned on to express the shape of a crosswalk. A pedestrian P can cross the road through the crosswalk displayed by the light emitting devices 30.

First described is an outline of the present embodiment. Details of the present embodiment will be described later.

When the control apparatus 20 detects a pedestrian who is about to cross the road, the control apparatus 20 causes the light emitting devices 30 to display a crosswalk. The control apparatus 20 detects, as a first vehicle, a vehicle traveling in a crosswalk display region where the crosswalk is to be displayed, and then, the control apparatus 20 determines whether or not the speed of the first vehicle is less than a reference speed. In a case where the speed is less than the reference speed and a predetermined safety standard is satisfied, the control apparatus 20 determines to cause the light emitting devices 30 to display the crosswalk. In a case where the control apparatus 20 specifies a vehicle following the first vehicle as a second vehicle and causes the light emitting devices 30 to display the crosswalk, the control apparatus 20 notifies the first vehicle and the second vehicle that the crosswalk is being displayed.

Thus, in the present embodiment, the crosswalk is determined to be displayed based on whether or not the speed of the first vehicle traveling in the crosswalk display region is less than the reference speed. Further, in a case where the crosswalk is displayed, the first vehicle and the second vehicle as a vehicle following the first vehicle are notified that the crosswalk is being displayed. Accordingly, even in a case where there are vehicles on the road, when the vehicles do not move due to a traffic jam or the like, it is possible to allow pedestrians to cross the road, thereby making it possible to improve convenience for the pedestrians. Further, in addition to the first vehicle, the second vehicle is also notified that the crosswalk is being displayed. Hereby, it is possible to prevent reckless driving by a driver of the second vehicle, thereby making it possible to improve safety for the pedestrians during road crossing.

Next will be described each constituent of the system 10 in detail.

Figure 2:
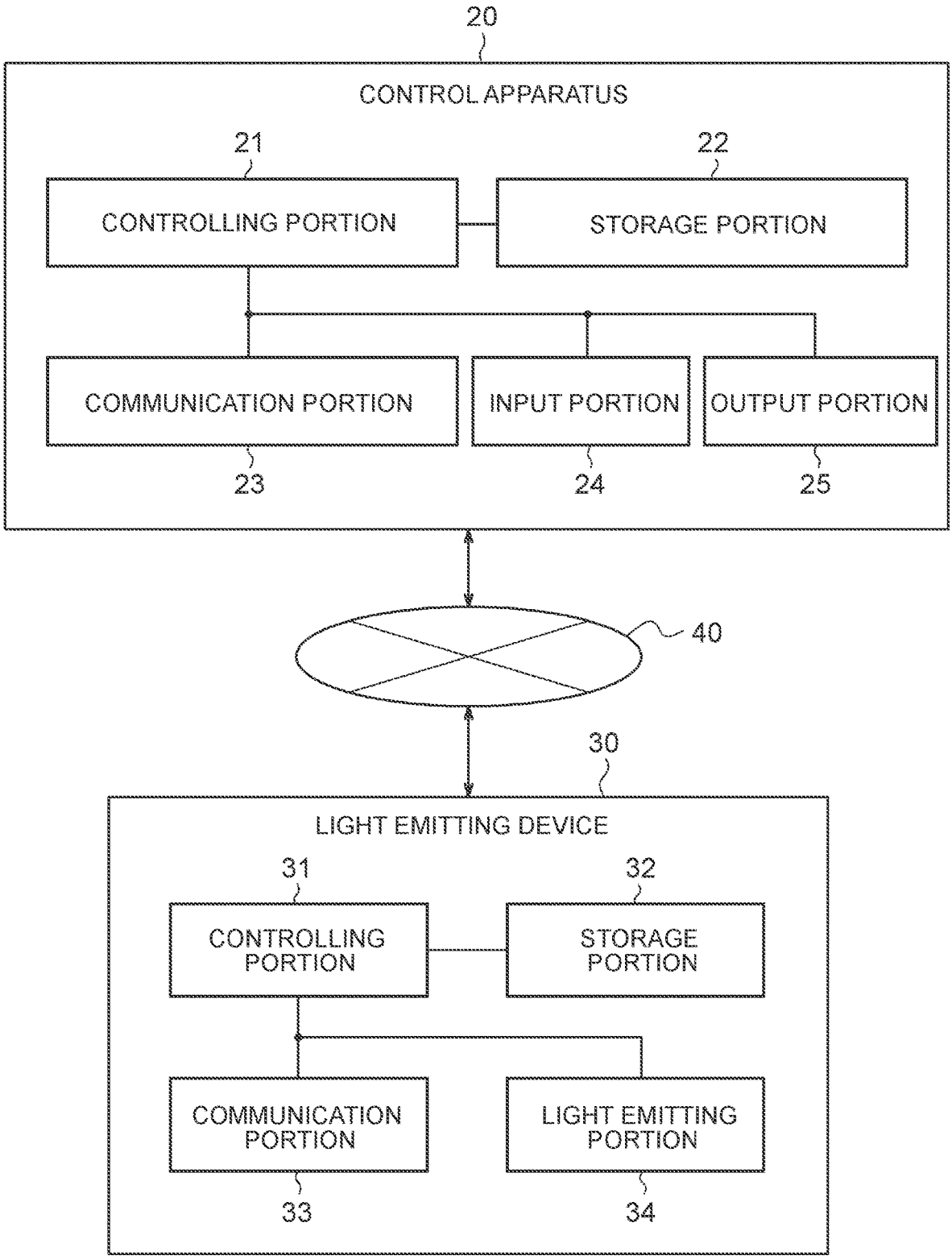
FIG. 2 is a block diagram illustrating configurations of a control apparatus and a light emitting device according to the present embodiment.

With reference to FIG. 2, the configuration of the control apparatus 20 according to the present embodiment will be described. The control apparatus 20 includes a controlling portion 21, a storage portion 22, a communication portion 23, an input portion 24, and an output portion 25.

The controlling portion 21 includes at least one processor, at least one dedicated circuit, or a combination thereof. The processor is a general purpose processor such as a CPU or a GPU, or a dedicated processor devoted to a specific process. The "CPU" is an abbreviation of Central Processing Unit. The "GPU" is an abbreviation of Graphics Processing Unit. The dedicated communication circuit is, for example, an FPGA or an ASIC. The "FPGA" is an abbreviation of Field-Programmable Gate Array. The "ASIC" is an abbreviation of Application Specific Integrated Circuit. The controlling portion 21 executes processing related to the operation of the control apparatus 20 while the controlling portion 21 controls each part of the control apparatus 20.

The storage portion 22 includes at least one semiconductor memory, at least one magnetic memory, at least one optical memory, or a combination of at least any two of them. The semiconductor memory is a RAM or a ROM, for example. The "RAM" is an abbreviation of Random Access Memory. The "ROM" is an abbreviation of Read Only Memory. The RAM is an SRAM or a DRAM, for example. The "SRAM" is an abbreviation of Static Random Access Memory. The "DRAM" is an abbreviation of Dynamic Random Access Memory. The ROM is an EEPROM, for example. The "EEPROM" is an abbreviation of Electrically Erasable Programmable Read Only Memory. The storage portion 22 functions as a main storage device, an auxiliary storage device, or a cache memory, for example. Information used for the operation of the control apparatus 20 and information obtained by the operation of the control apparatus 20 are stored in the storage portion 22.

The communication portion 23 includes at least one communications interface. The communications interface is an LAN interface, for example. The communication portion 23 receives information used for the operation of the control apparatus 20 and transmits information obtained by the operation of the control apparatus 20.

The input portion 24 includes at least one input interface. The input interface is, for example, a physical key, an electrostatic capacitive key, a pointing device, a touchscreen provided integrally with a display, or a microphone. The input portion 24 receives an operation to input information to be used for the operation of the control apparatus 20. Instead of being provided in the control apparatus 20, the input portion 24 may be connected to the control apparatus 20 as an external input device. As a connection method, any method such as USB, HDMI (registered trademark), or Bluetooth (registered trademark) can be used, for example. The "USB" is an abbreviation of Universal Serial Bus. The "HDMI" (registered trademark) is an abbreviation of High-Definition Multimedia Interface.

The output portion 25 includes at least one output interface. The output interface is, for example, a display or a speaker. The display is, for example, an LCD or an organic EL display. The "LCD" is an abbreviation of Liquid Crystal Display. The "EL" is an abbreviation of Electro Luminescence. The output portion 25 outputs information to be obtained by the operation of the control apparatus 20. Instead of being provided in the control apparatus 20, the output portion 25 may be connected to the control apparatus 20 as an external output device. As a connection method, any method such as USB, HDMI (registered trademark), or Bluetooth (registered trademark) can be used, for example.

Functions of the control apparatus 20 are implemented by executing a control program according to the present embodiment by a processor corresponding to the controlling portion 21. That is, the functions of the control apparatus 20 are implemented by software. The control program causes a computer to function as the control apparatus 20 by causing the computer to execute the operation of the control apparatus 20. That is, the computer functions as the control apparatus 20 by executing the operation of the control apparatus 20 in accordance with the control program.

The program can be stored in a non-transitory computer readable medium. The non-transitory computer readable medium is, for example, a magnetic recorder, an optical disc, a magneto-optical recording medium, or a semiconductor memory. The program is distributed by selling, transferring, or lending a portable recording medium such as a DVD or a CD-ROM in which the program is stored, for example. The "DVD" is an abbreviation of Digital Versatile Disc. The "CD-ROM" is an abbreviation of Compact Disc Read Only Memory. The program may be distributed by storing the program in a storage of a server and transferring the program to other computers from the server. The program may be provided as a program product.

The computer temporarily stores, in a main storage device, the program stored in the portable recording medium or the program transferred from the server, for example. Then, the computer reads, by the processor, the program stored in the main storage device and executes, by the processor, a process in accordance with the program thus read. The computer may directly read the program from the portable recording medium and execute the process in accordance with the program. The computer may sequentially execute the process in accordance with the received program every time the program is transferred to the computer from the server. The process may be executed by a so-called ASP service that implements the function only by an execution instruction and result acquisition without transferring the program from the server to the computer. The "ASP" is an abbreviation of Application Service Provider. The program includes a matter that is information used for processing by an electronic computer and is equivalent to the program. For example, data that is not a direct command to the computer but has a property defining the processing of the computer corresponds to "the matter equivalent to the program."

Some of or all of the functions of the control apparatus 20 may be implemented by a dedicated circuit corresponding to the controlling portion 21. That is, some of or all of the functions of the control apparatus 20 may be implemented by hardware.

With reference to FIG. 2, the configuration of the light emitting device 30 according to the present embodiment will be described. The light emitting device 30 includes a controlling portion 31, a storage portion 32, a communication portion 33, and a light emitting portion 34.

The controlling portion 31 includes at least one processor, at least one dedicated circuit, or a combination thereof. The processor is a general purpose processor such as a CPU or a GPU, or a dedicated processor devoted to a specific process. The dedicated communication circuit is, for example, an FPGA or an ASIC. The controlling portion 31 executes processing related to the operation of the light emitting device 30 while the controlling portion 31 controls each part of the light emitting device 30. The controlling portion 31 receives an instruction to turn on or off a light emitting element of the light emitting portion 34 from the control apparatus 20 via the communication portion 33. In response to the instruction, the controlling portion 31 performs a control on the light emitting portion 34 such the light emitting element is turned on or off.

The storage portion 32 includes at least one semiconductor memory, at least one magnetic memory, at least one optical memory, or a combination of at least any two of them. The semiconductor memory is a RAM or a ROM, for example. The RAM is an SRAM or a DRAM, for example. The ROM is an EEPROM, for example. The storage portion 32 functions as a main storage device, an auxiliary storage device, or a cache memory, for example. Information used for the operation of the light emitting device 30 and information obtained by the operation of the light emitting device 30 are stored in the storage portion 32.

The communication portion 33 includes at least one communications interface. The communications interface is, for example, an interface corresponding to a mobile communications standard such as an LTE, a 4G standard, or a 5G standard, an interface corresponding to short-distance wireless communications such as Bluetooth (registered trademark), or an LAN interface, for example. The "LTE" is an abbreviation of Long Term Evolution.

The "4G" is an abbreviation of 4th Generation. The "5G" is an abbreviation of 5th Generation. The communication portion 33 receives information used for the operation of the light emitting device 30 and transmits information obtained by the operation of the light emitting device 30.

The light emitting portion 34 includes at least one light emitting element and its control circuit. The light emitting element is, more specifically, an LED, an organic EL, or the like, but the light emitting element is not limited to them.

The light emitting device 30 has a tack shape and is provided in the road. An exposed part, on the road, of the light emitting device 30 is covered with a transparent cover. Hereby, when the light emitting element of the light emitting portion 34 emits light, a pedestrian on the road can recognize the light visually. In FIG. 1, some of the light emitting devices 30 provided in a road R emit light to display a crosswalk on the road R.

When the light emitting devices 30 emit light linearly, a boundary line between a crosswalk and a carriage way can be displayed. Alternatively, when the light emitting devices 30 emit light so as to display a shape having a given area, the crosswalk and the carriage way are can be displayed distinguishably. In this case, the light emitting devices 30 can display the crosswalk and the road distinguishably by changing the color of light emitted by the light emitting portions 34, changing a planar pattern displayed as a result of turning on the light emitting portions 34, or the like. Alternatively, when the light emitting devices 30 emit light so as to display a shape having a given area, a safety zone can be displayed on the carriage way.

Figure 3A:
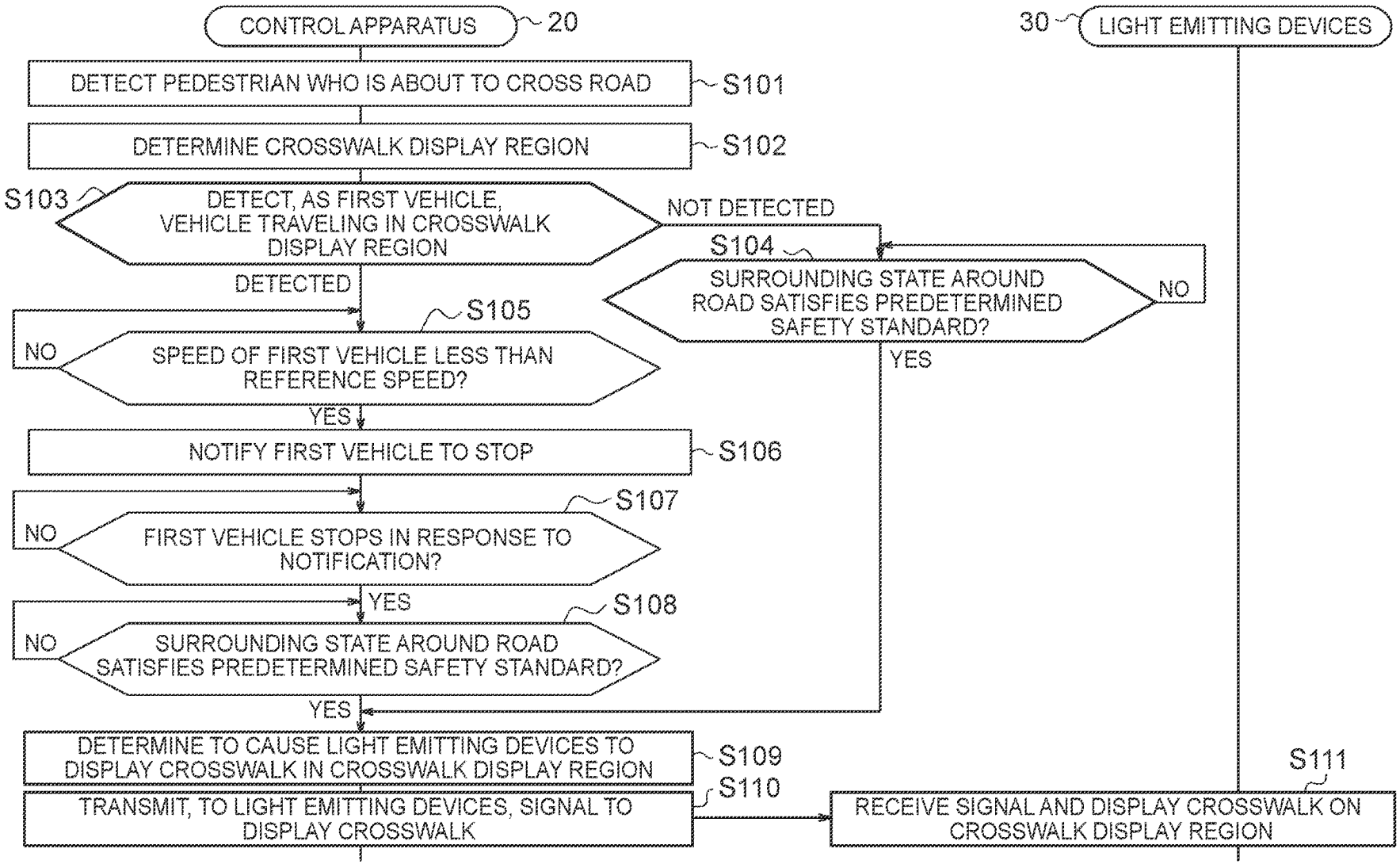
FIG. 3A is a view illustrating an operation of the system according to the present embodiment.
Figure 3B:
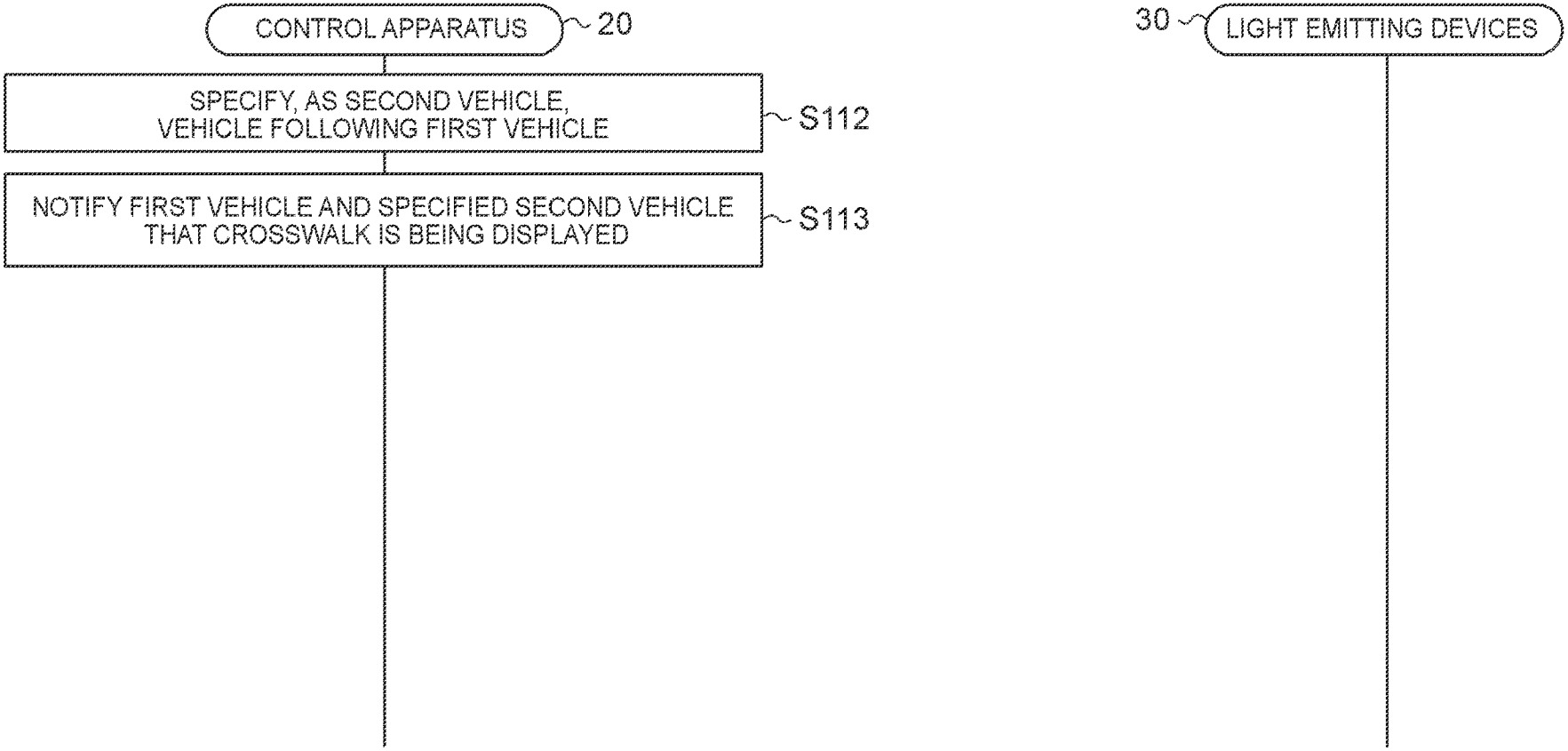
FIG. 3B is a view illustrating an operation of the system according to the present embodiment.

With reference to FIGS. 1, 3A, 3B, the following describes the operation of the system 10 according to the present embodiment. In the operation of the system 10, the operation of the control apparatus 20 corresponds to a method according to the present embodiment. In the following operations, the controlling portion 21 performs transmission and reception of information from outside via the communication portion 23. A vehicle in the following description may be driven by a driver or may perform self-driving from level 1 to level 5 defined by Society of Automotive Engineers (SAE), for example.

In step S101 in FIG. 3A, the controlling portion 21 of the control apparatus 20 detects a pedestrian who is about to cross the road.

A given technique can be employed to detect a pedestrian. For example, the controlling portion 21 may acquire a road crossing request from a terminal device used by a pedestrian via the communication portion 23 and may detect the pedestrian as the pedestrian who is about to cross the road. Alternatively, the controlling portion 21 may acquire, from a terminal device used by a pedestrian, information on a scheduled course of the pedestrian and position information indicative of the position of the pedestrian. These pieces of information are provided by an active route guidance application in the terminal device. Then, the controlling portion 21 may detect a pedestrian arriving at the vicinity of the road as the pedestrian who is about to cross the road, based on these pieces of information thus acquired. Alternatively, the controlling portion 21 is provided around the road and communicates with a floor material including a load sensor. The controlling portion 21 may detect a pedestrian when the controlling portion 21 receives, from the load material, a signal generated by the load sensor and indicating that the pedestrian performs a predetermined motion. In this case, the predetermined motion includes, for example, a motion of the pedestrian pushing down, by a foot, a crossing request switch provided on the floor material. Alternatively, the controlling portion 21 may communicate with a camera configured to capture an image around the road via the communication portion 23 and may receive and analyze the image captured by the camera. Then, the controlling portion 21 may detect a pedestrian performing a predetermined motion such as raising a hand near the road, as the pedestrian who is about to cross the road, based on a result of the analysis. In this case, the controlling portion 21 may detect a plurality of pedestrians who are about to cross the road.

For example, the controlling portion 21 detects a pedestrian P as a pedestrian who is about to cross the road R, by receiving and analyzing an image captured by the camera C in FIG. 1. The controlling portion 21 detects the pedestrian P being accompanied by a child.

In step S102, the controlling portion 21 determines a crosswalk display region.

The crosswalk display region is a region in which the light emitting devices 30 display a crosswalk on the road. The crosswalk display region is determined based on information on a pedestrian, the position of the pedestrian, a direction in which the pedestrian is about to cross the road, or the like.

For example, in a case where the controlling portion 21 acquires information on a health condition of the pedestrian and determines that the pedestrian sits on a wheelchair, the controlling portion 21 may determine that the width of the crosswalk display region is set to be wider than that in a case where the pedestrian is a physically unimpaired person. Alternatively, in a case where the controlling portion 21 detects a plurality of pedestrians, the controlling portion 21 may determine that the width of the crosswalk display region is set to be wider than that in a case of one pedestrian. Alternatively, the controlling portion 21 may determine that the extending direction of the crosswalk display region has an angle to the road, based on a scheduled course of a pedestrian to be provided by an active route guidance application in a terminal device of the pedestrian. Thus, the width, direction, or the like of the crosswalk display region may be set freely.

In FIG. 1, in a case where the controlling portion 21 detects the pedestrian P being accompanied by a child, the controlling portion 21 determines that the width of a crosswalk display region A is set to be wider than that in a case where the pedestrian P is alone.

In step S103, the controlling portion 21 detects, as the first vehicle, a vehicle traveling in the crosswalk display region determined in step S102. In a case where the first vehicle is not detected, the process of the controlling portion 21 proceeds to step S104. In a case where the first vehicle is detected, the process of the controlling portion 21 proceeds to step S105.

A given technique can be employed to detect the first vehicle. For example, based on position information acquired from a vehicle traveling in the crosswalk display region, the controlling portion 21 may detect the vehicle as the first vehicle. Alternatively, the controlling portion 21 may communicate with a camera configured to capture an image around the crosswalk display region and may receive and analyze the image captured by the camera. Then, the controlling portion 21 may detect, as the first vehicle, a vehicle traveling in the crosswalk display region based on a result of the analysis.

In FIG. 1, the controlling portion 21 detects, as a first vehicle V1, a vehicle traveling in the crosswalk display region A based on an image captured by a camera C.

First described is a case where the first vehicle is not detected in step S103, and the process of the controlling portion 21 proceeds to step S104. In step S104, the controlling portion 21 determines whether a surrounding state around the road satisfies a predetermined safety standard or not. The process of step S104 is repeated until the controlling portion 21 determines that the surrounding state around the road satisfies the predetermined safety standard. In a case where the controlling portion 21 determines that the surrounding state around the road satisfies the predetermined safety standard, the process of the controlling portion 21 proceeds to step S109.

The safety standard is a criterion for a pedestrian to cross the road safely and may be set optionally. For example, the safety standard includes a state where, within a predetermined distance from the position of the pedestrian, no vehicle or bicycle is traveling at a predetermined speed or more and heading to the road that the pedestrian is about to cross. In this case, the controlling portion 21 receives an image from a camera provided within a predetermined range from the position of the pedestrian, the camera being configured to capture an image of the road. The predetermined range indicates, for example, a range within a distance of 500 meters, but the predetermined range is not limited to this. The controlling portion 21 analyzes the image thus received and determines whether or not there is a vehicle or bicycle traveling at the predetermined speed or more and heading to the road. Thus, the controlling portion 21 determines whether the safety standard is satisfied or not. Alternatively, the controlling portion 21 may acquire position information from a vehicle or a bicycle traveling around the position of the pedestrian and detect, based on the position information, whether or not there is a vehicle or bicycle traveling at the predetermined speed or more and heading to the road.

Next will be described a case where the first vehicle is detected in step S103, and the process of the controlling portion 21 proceeds to step S105. In step S105, the controlling portion 21 determines whether or not the speed of the first vehicle is less than the reference speed. The process of step S105 is repeated until the controlling portion 21 determines that the speed of the first vehicle is less than the reference speed. In a case where the controlling portion 21 determines that the speed of the first vehicle is less than the reference speed, the process of the controlling portion 21 proceeds to step S106.

The "reference speed" is a speed of the vehicle at the time when a traffic jam occurs and is a value of 10 kilometers per an hour, for example. The reference speed may be set freely. A given technique can be employed for the determination on the speed of the first vehicle. For example, the controlling portion 21 may receive speed information on the first vehicle and performs the determination based on the speed information. The speed information includes a measured value measured by an acceleration sensor. Alternatively, the controlling portion 21 may communicate with a camera configured to capture an image around the crosswalk display region via the communication portion 23, analyze the image captured by the camera, and determine the speed of the first vehicle. Alternatively, the controlling portion 21 may receive position information on the first vehicle and determine the speed of the first vehicle based on the position information.

FIG. 1 assumes a case where a traffic jam occurs on the road R, and the speed of the first vehicle V1 is eight kilometers per an hour. The controlling portion 21 receives speed information on the first vehicle V1 and determines that the speed of the first vehicle V1 is less than the reference speed.

In step S106, the controlling portion 21 notifies the first vehicle to stop.

A given technique can be employed for the notification to the first vehicle. For example, the controlling portion 21 transmits, to the first vehicle via the communication portion 23, a notification to request the first vehicle to stop. In this case, a controlling portion of the first vehicle receives the notification via a communication portion of the first vehicle and controls each part of the first vehicle in response to the notification such that the first vehicle stops. The controlling portion of the first vehicle may inform a driver to stop by voice or a video image.

In step S107, the controlling portion 21 determines whether or not the first vehicle has stopped in response to the notification. The process of step S107 is repeated until the controlling portion 21 determines that the first vehicle has stopped in response to the notification. In a case where the controlling portion 21 determines that the first vehicle has stopped in response to the notification, the process of the controlling portion 21 proceeds to step S108.

A given technique can be employed to determine that the first vehicle has stopped in response to the notification. For example, the controlling portion 21 acquires position information on the first vehicle and determines whether or not the first vehicle has stopped. Alternatively, the controlling portion 21 may determine whether or not the first vehicle has stopped, by receiving and analyzing an image captured by a camera configured to capture an image of the road. Alternatively, the controlling portion 21 may determine whether or not the first vehicle has stopped, by receiving and analyzing an image captured by an in-vehicle camera provided in the first vehicle.

In FIG. 1, the controlling portion 21 transmits, to the first vehicle V1, a notification to request the first vehicle V1 to stop. The first vehicle V1 stops in response to the received notification. The controlling portion 21 acquires an image of the first vehicle V1, captured by the camera C, and determines that the first vehicle V1 has stopped.

In step S108, the controlling portion 21 determines whether or not the surrounding state around the road satisfies a predetermined safety standard. The process of step S108 is repeated until the controlling portion 21 determines that the surrounding state around the road satisfies the predetermined safety standard. In a case where the controlling portion 21 determines that the surrounding state around the road satisfies the predetermined safety standard, the process of the controlling portion 21 proceeds to step S109.

Details of the safety standard are similar to those in step S104, and therefore, descriptions thereof are omitted.

In step S109, the controlling portion 21 determines to cause the light emitting devices 30 to display a crosswalk in the crosswalk display region.

The controlling portion 21 selects one or more light emitting devices 30 to be controlled, from among the light emitting devices 30 provided in the road. The selection of the light emitting devices 30 is performed based on the shape of the crosswalk display region. Respective positions of the light emitting devices 30 may be stored in the storage portion 22 of the control apparatus 20 in advance.

In step S110, the controlling portion 21 transmits, to the light emitting devices 30, a signal to instruct the light emitting devices 30 to display a crosswalk.

The controlling portion 21 transmits, to the one or more light emitting devices 30 selected in step S109, a signal to instruct them to turn on the light emitting portions 34 of the one or more light emitting devices 30.

In step S111, the light emitting devices 30 receive the signal from the controlling portion 21 and display the crosswalk in the crosswalk display region.

The controlling portions 31 of the one or more light emitting devices 30 receive the signal from the control apparatus 20 via the communication portions 33 of the one or more light emitting devices 30 and turn on or blink the light emitting portions 34 of the one or more light emitting devices 30. Light emitted from the light emitting portions 34 forms the shape of the crosswalk as a whole. Hereby, the crosswalk is displayed on the crosswalk display region, so that the pedestrian can cross the road safely.

In step S112, the controlling portion 21 specifies a vehicle following the first vehicle as the second vehicle.

The second vehicle is a vehicle traveling behind the first vehicle, in the same lane as the first vehicle. One vehicle may be specified as the second vehicle, or a plurality of vehicles may be specified as the second vehicle. For example, the controlling portion 21 may acquire position information on each vehicle on the road and specify, as the second vehicle, the first two vehicles from the first vehicle from among a plurality of vehicles following the first vehicle. Alternatively, the controlling portion 21 may specify, as the second vehicle, vehicles present in a range where the first vehicle is communicable with the vehicles by short-distance wireless communication. Conditions to specify the second vehicle are not limited to this and may be defined freely.

For example, the controlling portion 21 may acquire and analyze images captured by respective in-vehicle cameras provided in a plurality of vehicles following the first vehicle and specify the second vehicle. Any method can be employed as an image analysis method. In this case, the controlling portion 21 may specify, as the second vehicle, a vehicle that has captured an image including the first vehicle ahead of the vehicle in its advancing direction. For example, the controlling portion 21 acquires images captured by respective in-vehicle cameras of vehicles V2, V3, V4 as the vehicles following the first vehicle V1 in FIG. 1 and analyzes the images. The controlling portion 21 determines that the image acquired from the vehicle V2 includes the first vehicle V1 ahead of the vehicle V2 in the advancing direction. The controlling portion 21 specifies the vehicle V2 as the second vehicle.

Alternatively, the controlling portion 21 may specify, as the second vehicle, a vehicle that has captured an image including a vehicle traveling ahead of the crosswalk in the advancing direction, that is, a vehicle traveling ahead of the first vehicle. For example, the controlling portion 21 acquires images captured by respective in-vehicle cameras of the vehicles V2, V3, V4 as the vehicles following the first vehicle V1 in FIG. 1 and analyzes the images. The controlling portion 21 determines that the image acquired from the vehicle V2 includes a vehicle traveling ahead of the displayed crosswalk in the advancing direction, that is, a vehicle V0 traveling ahead of the first vehicle V1. At this time, the controlling portion 21 specifies the vehicle V2 as the second vehicle.

In step S113, the controlling portion 21 notifies the first vehicle and the specified second vehicle that the crosswalk is being displayed. After that, the operation of the control apparatus 20 is ended.

A given technique can be employed for the notification to the first vehicle and the second vehicle. For example, the controlling portion 21 communicates with the first vehicle and the second vehicle and notifies them that the crosswalk is being displayed. In a case where the first vehicle and the second vehicle receive the notification, respective controlling portions of the first vehicle and the second vehicle may inform respective drivers of the crosswalk being displayed by voice or a video image. Further, the notification to the second vehicle may be performed from the first vehicle.

Alternatively, the controlling portion 21 may display, on a roadside object of the road, information indicating that the crosswalk is being displayed. In this case, the controlling portion 21 first specifies a roadside object present within a reference distance from the crosswalk based on information indicative of the position of the crosswalk thus displayed and information indicative of the position of the roadside object on a map, the position being stored in advance. The reference distance is a distance of 10 meters, for example. The roadside object includes a guard rail, a signboard, or the like that can perform electronic display. The controlling portion 21 transmits, to the specified roadside object, a signal to instruct the specified roadside object to display information indicating that the crosswalk is being displayed. The roadside object receiving the signal displays the information indicating that the crosswalk is being displayed. Respective drivers of the first vehicle and the second vehicle recognize electronic display. As such, the information indicating that the crosswalk is being displayed may be notified to the first vehicle and the second vehicle via the roadside object.

Alternatively, the controlling portion 21 may cause the light emitting device 30 to notify the first vehicle and the second vehicle that the crosswalk is being displayed. In this case, the controlling portion 21 transmits, to the light emitting devices 30 selected in step S109, a signal to instruct the selected light emitting devices 30 to notify the first vehicle and the second vehicle that the crosswalk is being displayed. The light emitting devices 30 receiving the signal notify, by short-distance communication, the first vehicle and the second vehicle that the crosswalk is being displayed. In a case where the first vehicle and the second vehicle receive the notification from the light emitting devices 30, respective controlling portions of the first vehicle and the second vehicle inform their respective drivers of the crosswalk being displayed by voice or a video image.

In the present embodiment, the controlling portion 21 notifies the first vehicle V1 and the second vehicle V2 in FIG. 1 that the crosswalk is being displayed.

As described above, the control apparatus 20 according to the present embodiment is a control apparatus configured to cause the light emitting devices to display a crosswalk when the control apparatus detects a pedestrian who is about to cross a road. The control apparatus 20 includes the controlling portion 21 configured to perform the followings: detecting, as the first vehicle, a vehicle traveling in a crosswalk display region where the crosswalk is to be displayed; determining whether or not the speed of the first vehicle is less than the reference speed; and in a case where the speed is less than the reference speed and a predetermined safety standard is satisfied, determining to cause the light emitting devices 30 to display the crosswalk in the crosswalk display region.

In a case where the speed of the vehicle on the crosswalk display region is slow and the pedestrian can cross the road safely, the controlling portion 21 causes the vehicle on the crosswalk display region to stop and then displays the crosswalk. Hereby, it is possible to prevent occurrence of such a situation that the pedestrian cannot cross the road even though a state where the pedestrian can cross the road safely is established. The controlling portion 21 determines whether the predetermined safety standard is satisfied or not and causes the light emitting devices 30 to display the crosswalk. Hereby, it is possible to improve convenience for the pedestrian and safety for the pedestrian during road crossing.

As described above, in a case where the controlling portion 21 causes the light emitting devices 30 to display the crosswalk, the controlling portion 21 causes the roadside object of the road to display information indicating that the crosswalk is being displayed.

Since the information indicating that the crosswalk is being displayed is display on the roadside object of the road, when a driver of a vehicle on the road sees the roadside object, the driver can recognize that the crosswalk is being displayed. This makes it is possible to prevent the vehicle from moving forward by mistake while the crosswalk is being displayed. This accordingly makes it possible to improve convenience for the pedestrian and safety for the pedestrian during road crossing.

As described above, in a case where the controlling portion 21 specifies a vehicle following the first vehicle as the second vehicle and causes the light emitting devices 30 to display the crosswalk, the controlling portion 21 notifies the first vehicle and the second vehicle that the crosswalk is being displayed.

Since the first vehicle and the second vehicle are notified that the crosswalk is being displayed, it is possible to surely stop the first vehicle present in the crosswalk display region. Further, the driver of the second vehicle can easily recognize why the first vehicle ahead of the second vehicle is stopping, it is possible to prevent the driver of the second vehicle from feeling frustrated at the first vehicle and driving recklessly. This accordingly makes it possible to improve convenience for the pedestrian and safety for the pedestrian during road crossing.

As described above, the controlling portion 21 notifies, via the light emitting devices 30, the first vehicle and the second vehicle that the crosswalk is being displayed.

The light emitting devices 30 can notify, by short-distance communication, the first vehicle and the second vehicle that the crosswalk is being displayed. Hereby, the drivers of the first vehicle and the second vehicle can more quickly and surely recognize that the crosswalk is being displayed, thereby making it possible to prevent reckless driving. This accordingly makes it possible to improve convenience for the pedestrian and safety for the pedestrian during road crossing.

As described above, the controlling portion 21 determines, based on position information of a vehicle, whether or not the vehicle is traveling in the crosswalk display region.

The controlling portion 21 can surely detect the first vehicle traveling in the crosswalk display region based on the position information on the vehicle. Since the first vehicle to stop can be detected properly, the crosswalk that the pedestrian can cross safely can be displayed. This accordingly makes it possible to improve convenience for the pedestrian and safety for the pedestrian during road crossing.

As described above, the controlling portion 21 determines whether or not the speed of the first vehicle is less than the reference speed, based on speed information acquired from the first vehicle.

By acquiring, from the first vehicle, the speed information such as a measured value measured by an acceleration sensor of the first vehicle, the controlling portion 21 can determined the speed of the first vehicle more properly. Further, since a reference speed is in advance, it is possible to surely stop the first vehicle and cause the light emitting devices 30 to display a crosswalk only in a case where the speed of the first vehicle is a given speed or lower. This accordingly makes it possible to improve convenience for the pedestrian and safety for the pedestrian during road crossing.

This disclosure is not limited to the above embodiment. For example, a plurality of blocks described in the block diagram may be integrated, or one block may be divided. Instead of sequentially executing a plurality of steps described in the flowchart in accordance with the description, they may be executed in parallel or in a different order in accordance with processing capacities of devices that execute respective steps or as necessary. Furthermore, this disclosure may be variously modified without departing from the gist of the disclosure.

First Modification

Next will be described a first modification of the embodiment of this disclosure. In the present modification, in a case where the road includes an on-coming lane, the controlling portion 21 determines whether a third vehicle as a vehicle traveling in the on-coming lane is present or not. In a case where the third vehicle is not present and the predetermined safety standard is satisfied, the controlling portion 21 determines to cause the light emitting devices 30 to display, in an exchanged manner, the on-coming lane and a sidewalk across the road that a pedestrian is about to cross.

Since the configuration of the system 10 according to the first modification is similar to that in the above embodiment, the description thereof is omitted. Since the configurations of the control apparatus 20 and the light emitting devices 30 according to the first modification are similar to those in the above embodiment, the descriptions thereof are omitted.

The following describes a difference between the operation of the system 10 according to the above embodiment and the operation of the system 10 according to the present modification with reference to FIGS. 3A, 3B, 4A, 4B, 5A, 5B.

Figure 4A:
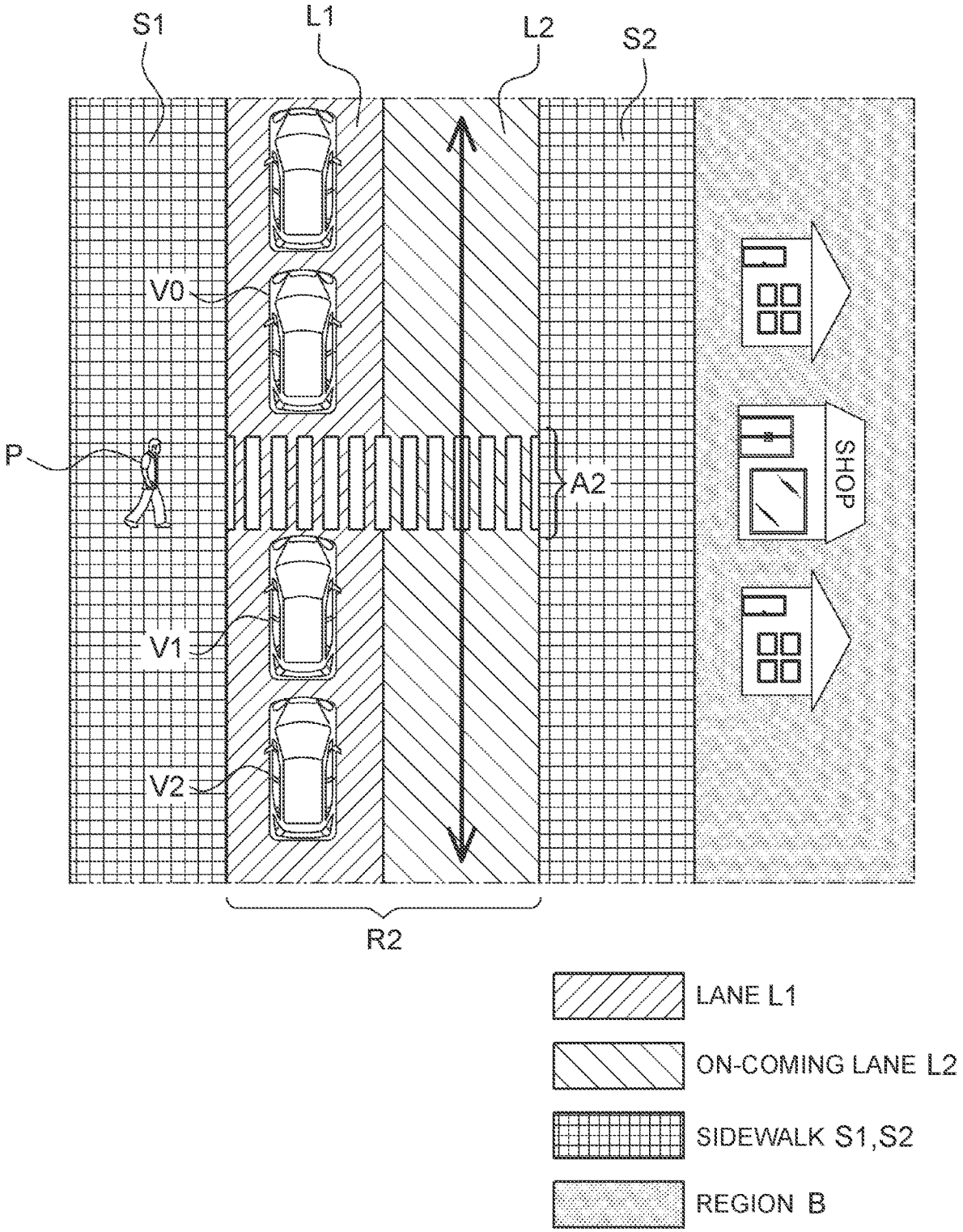
FIG. 4A is a view to describe a first modification.

In the present modification, a road R2 in FIG. 4A includes a lane L1 in which the first vehicle V1 and the second vehicle V2 travel, and an on-coming lane L2. The pedestrian P is about to cross the road R2 to move from a sidewalk S1 to a region B on a sidewalk S2 side through the sidewalk S2 The sidewalk S2 is a sidewalk across the road R2 that the pedestrian P is about to cross. In the region B, a commercial facility, a house, and so on are present.

Figure 5A:
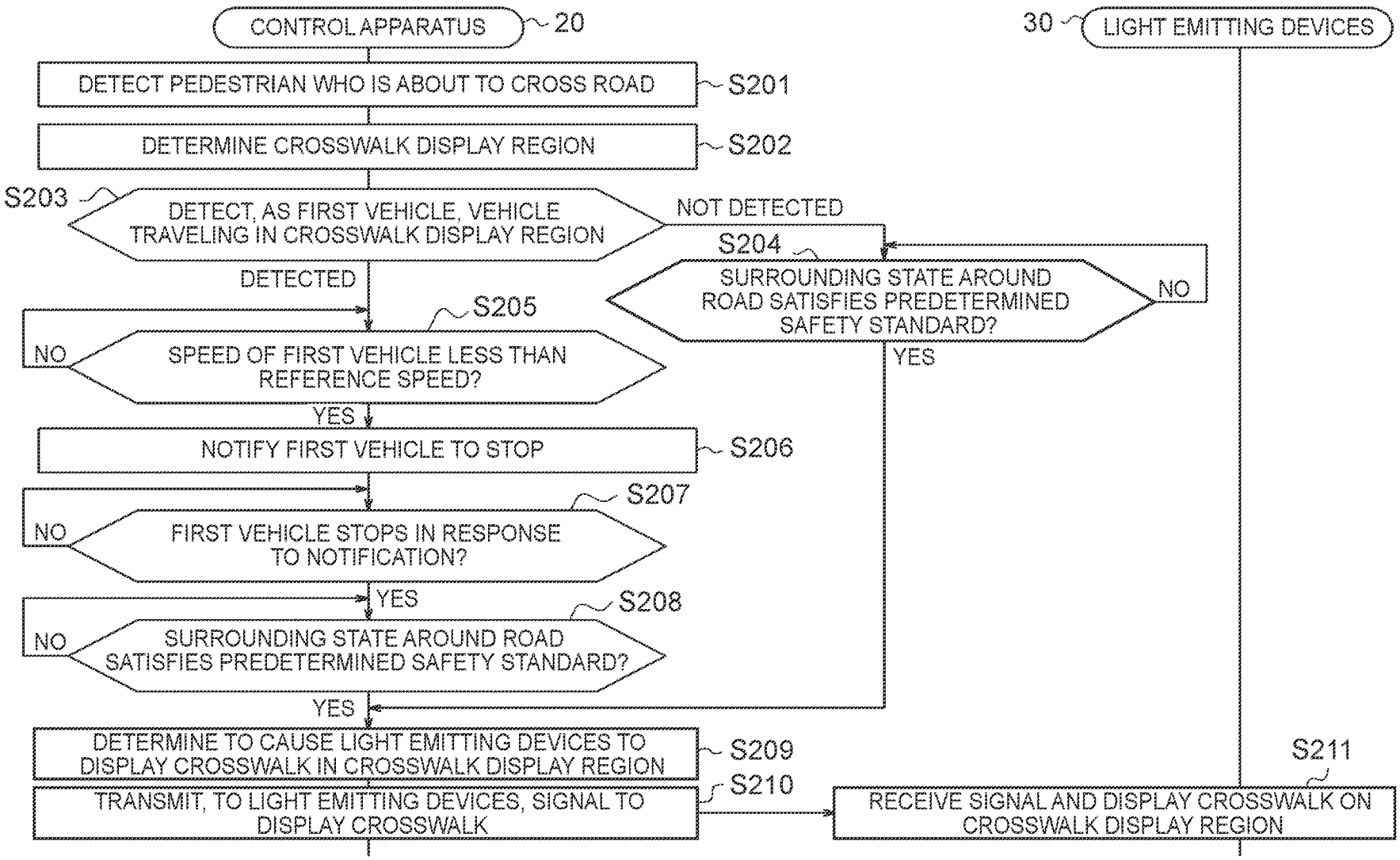
FIG. 5A is a view illustrating an operation of a system according to the first modification.

Steps S201 to S211 in FIG. 5A are similar to steps S101 to S111 in FIG. 3A according to the above embodiment and therefore are not described herein.

Figure 5B:
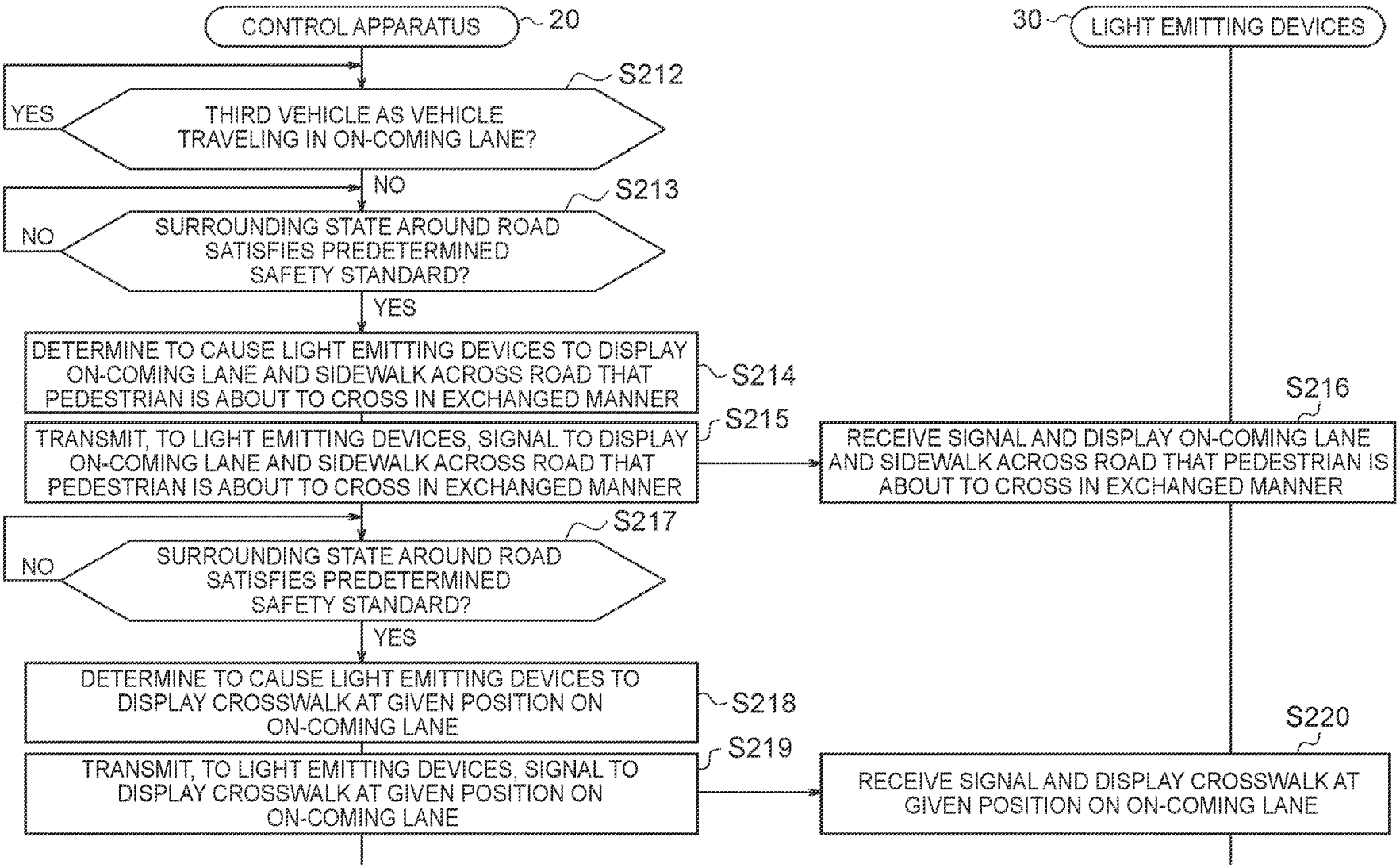
FIG. 5B is a view illustrating an operation of the system according to the first modification.

In step S212 in FIG. 5B, the controlling portion 21 determines whether the third vehicle as a vehicle traveling in the on-coming lane is present or not. The process of step S212 is repeated until the controlling portion 21 determines that the third vehicle is not present. In a case where the controlling portion 21 determines that the third vehicle is not present, the process of the controlling portion 21 proceeds to step S213.

More specifically, the controlling portion 21 specifies a predetermined zone in the on-coming lane and determines whether or not a traveling vehicle is present in the zone. The predetermined zone is, for example, a zone from a given corner to its next corner. In this case, the crosswalk display region is included between these two corners. The predetermined zone is not limited to this and may be a zone separated from the crosswalk display region by a sufficient distance, for example. The sufficient distance is, for example, a distance from one kilometer ahead of the crosswalk display region to one kilometer behind the crosswalk display region along the on-coming lane.

As indicated by an arrow mark in FIG. 4A, the predetermined zone is set to a range from one kilometer ahead of a crosswalk display region A2 to one kilometer behind the crosswalk display region A2 along the on-coming lane. The controlling portion 21 determines whether the third vehicle traveling in the predetermined zone indicated by the arrow mark is present or not. In the present example, the controlling portion 21 determines that the third vehicle is not present.

A given technique can be employed for the determination on whether the third vehicle is present or not. For example, the controlling portion 21 may communicate with a camera configured to capture an image around the road and may receive and analyze data of the image captured by the camera. The controlling portion 21 may determine that the third vehicle is not present, based on a result of the analysis. Alternatively, the controlling portion 21 may determine whether the third vehicle is present in the on-coming lane or not, by acquiring and analyzing an image captured by an in-vehicle camera provided in a vehicle present in a lane opposite to the on-coming lane, that is, in a lane where the first vehicle is traveling.

In step S213, the controlling portion 21 determines whether a surrounding state around the road satisfies a predetermined safety standard or not. The process of step S213 is repeated until the controlling portion 21 determines that the surrounding state around the road satisfies the predetermined safety standard. In a case where the controlling portion 21 determines that the surrounding state around the road satisfies the predetermined safety standard, the process of the controlling portion 21 proceeds to step S214.

Details of the safety standard are similar to those in step S104 in FIG. 3A according to the above embodiment and therefore are not described herein.

In step S214, the controlling portion 21 determines to cause the light emitting devices 30 to display, in an exchanged manner, the on-coming lane and the sidewalk across the road that the pedestrian is about to cross.

The controlling portion 21 selects one or more light emitting devices 30 to be controlled from among the light emitting devices 30 provided in the road. The selection of the light emitting devices 30 is performed based on respective widths of the on-coming lane and the sidewalk to be exchanged, or the like. Respective positions of the light emitting devices 30 may be stored in the storage portion 22 of the control apparatus 20 in advance.

In step S215, the controlling portion 21 transmits, to the light emitting devices 30, a signal to instruct the light emitting devices 30 to display, in an exchanged manner, the on-coming lane and the sidewalk across the road that the pedestrian is about to cross.

The controlling portion 21 transmits, to the one or more light emitting devices 30 selected in step S214 via the communication portion 23, a signal to instruct them to turn on the light emitting portions 34 of the one or more light emitting devices 30.

In step S216, the light emitting devices 30 receive the signal from the controlling portion 21 and display, in an exchanged manner, the on-coming lane and the sidewalk across the road that the pedestrian is about to cross.

The controlling portions 31 of the one or more light emitting devices 30 receive the signal from the control apparatus 20 via the communication portions 33 of the one or more light emitting devices 30 and turn on or blink the light emitting portions 34 of the one or more light emitting devices 30. Light emitted from the light emitting portions 34 forms, on the road, the on-coming lane and the sidewalk the positions of which have been exchanged. The light emitting devices 30 can distinguishably display the lane, the sidewalk, and so on by changing a planar pattern expressed by the light emitted from the light emitting portions 34, the color of the light, or the like.

Figure 4B:
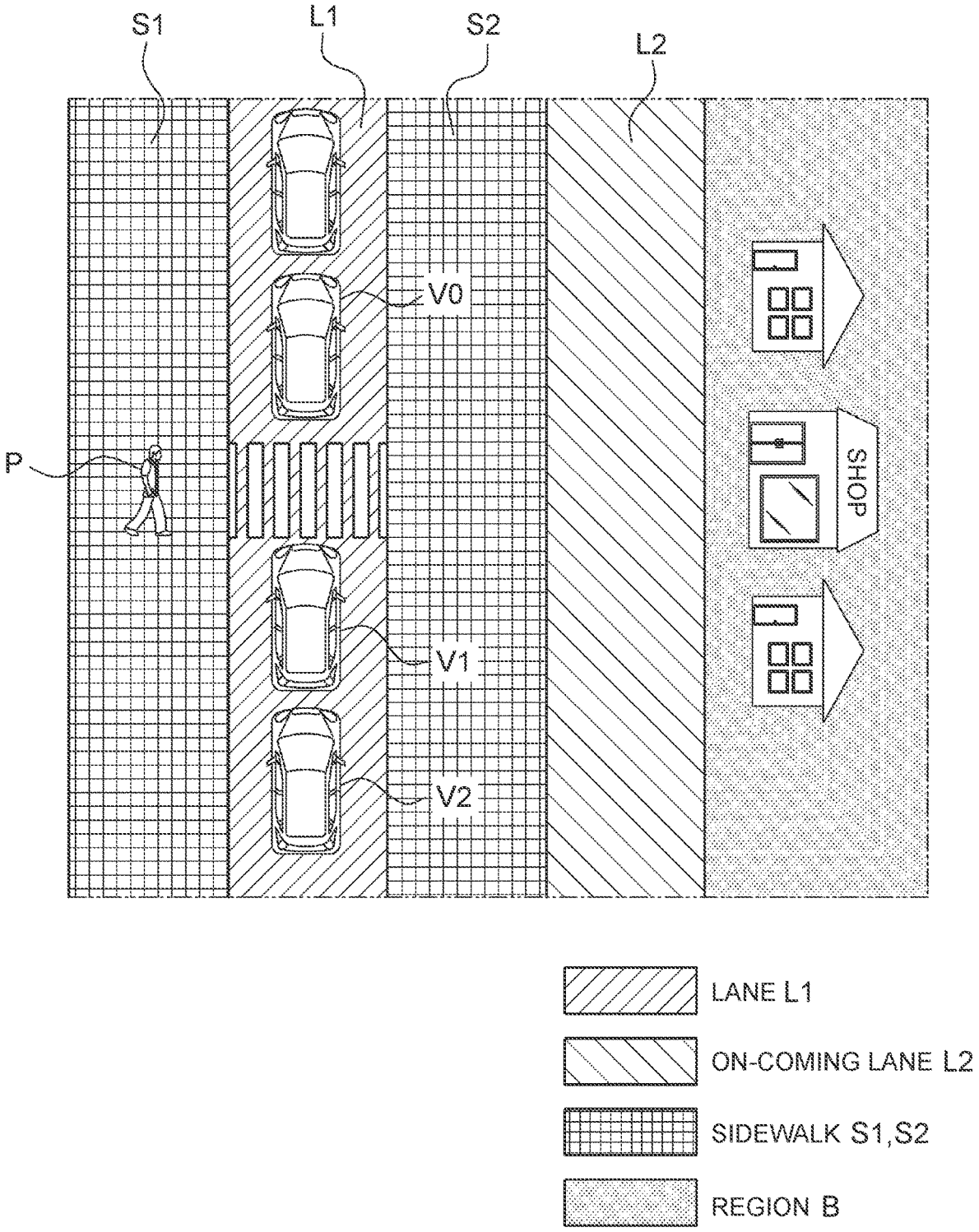
FIG. 4B is a view to describe the first modification.

In FIG. 4B, the light emitting devices 30 are controlled by the controlling portion 21, so that the on-coming lane L2 and the sidewalk S2 are displayed in an exchanged manner. In FIG. 4A, the sidewalk S1, the lane L1, the on-coming lane L2, and the sidewalk S2 are illustrated in this order from the left side in the figure. However, with reference to FIG. 4B, the sidewalk S1, the lane L1, the sidewalk S2, and the on-coming lane L2 are illustrated in this order from the left side in the figure. Thus, the on-coming lane L2 and the sidewalk S2 on the opposite side to the position of the pedestrian P across the road are displayed in an exchanged manner by the light emitting devices 30. At this time, the light emitting devices 30 may freshly display a short crosswalk as illustrated in FIG. 4B. Hereby, the pedestrian P can move into a region only for pedestrians more quickly and safely than the case of FIG. 4A.

The processes from step S208 to step S211 in FIG. 5A may be performed at the same time as the processes from step S212 to step S216.

In step S217, after the pedestrian P has crossed the lane L1 and reached the sidewalk S2, the controlling portion 21 determines again whether the surrounding state around the road satisfies the predetermined safety standard or not. The process of step S217 is repeated until the controlling portion 21 determines that the surrounding state around the road satisfies the predetermined safety standard. In a case where the controlling portion 21 determines that the surrounding state around the road satisfies the predetermined safety standard, the process of the controlling portion 21 proceeds to step S218.

The determination on whether or not the pedestrian has crossed the lane may be performed by any technique. For example, the controlling portion 21 may acquire position information of a terminal device used by the pedestrian and may determine, based on the position information, that the pedestrian has crossed the lane. Details of the safety standard are similar to those in step S104 in FIG. 3A according to the above embodiment and therefore are not described herein.

In step S218, the controlling portion 21 determines to cause the light emitting devices 30 to display the crosswalk at a given position.

In step S219, the controlling portion 21 transits, to the light emitting devices 30, a signal to instruct the light emitting devices 30 to display the crosswalk at the given position on the on-coming lane.

In step S220, the light emitting devices 30 receive the signal from the controlling portion 21 and display the crosswalk at the given position on the on-coming lane. Hereby, the pedestrian can cross the on-coming lane, so that the pedestrian can completely cross the road. After that, the operation of the control apparatus 20 is ended.

Details of steps S218 to S220 are similar to those of steps S109 to S111 in FIG. 3A according to the above embodiment and therefore are not described herein.

The processes from step S218 to step S220 may be performed at any timings and may be performed after a road crossing request is received from the pedestrian, for example.

As described above, in the control apparatus 20 according to the present modification, in a case where the road includes an on-coming lane, the controlling portion 21 determines whether the third vehicle as a vehicle traveling in the on-coming lane is present or not. In a case where the third vehicle is not present and the predetermined safety standard is satisfied, the controlling portion 21 determines to cause the light emitting devices 30 to display, in an exchanged manner, the on-coming lane and the sidewalk across the road that the pedestrian is about to cross.

In the present modification, in a case where no vehicle is present in the on-coming lane, the on-coming lane and the sidewalk across the road that the pedestrian is about to cross are displayed in an exchanged manner under the condition that the predetermined safety standard is satisfied. Hereby, the distance of the crosswalk through which the pedestrian is about to cross the road shortens, so that the pedestrian can reach the sidewalk quickly. This accordingly makes it possible to improve convenience for the pedestrian and safety for the pedestrian during road crossing.

Second Modification

Next will be described a second modification of the embodiment of this disclosure. In the present modification, in a case where the road includes an on-coming lane, the controlling portion 21 determines whether the third vehicle as a vehicle traveling on the on-coming lane is present or not. In a case where the third vehicle is not present and a predetermined safety standard is satisfied, the controlling portion 21 determines to cause the light emitting devices 30 to display a safety zone across the road that the pedestrian is to cross.

Since the configuration of the system 10 according to the second modification is similar to that in the above embodiment, the description thereof is omitted. Since the configurations of the control apparatus 20 and the light emitting devices 30 according to the second modification are similar to those in the above embodiment, the descriptions thereof are omitted.

The following describes a difference between the operation of the system 10 according to the above embodiment and the operation of the system 10 according to the present modification with reference to FIGS. 3A, 3B, 4A, 6, 7A, 7B.

Similarly to the first modification, the road R2 in FIG. 4A includes the lane L1 where the first vehicle V1 and the second vehicle V2 travel, and the on-coming lane L2. The pedestrian P is about to cross the road R2 to move from the sidewalk S1 to the region B on the sidewalk S2 side through the sidewalk S2. The sidewalk S2 is a sidewalk across the road R2 that the pedestrian P2 is about to cross.

Figure 7A:
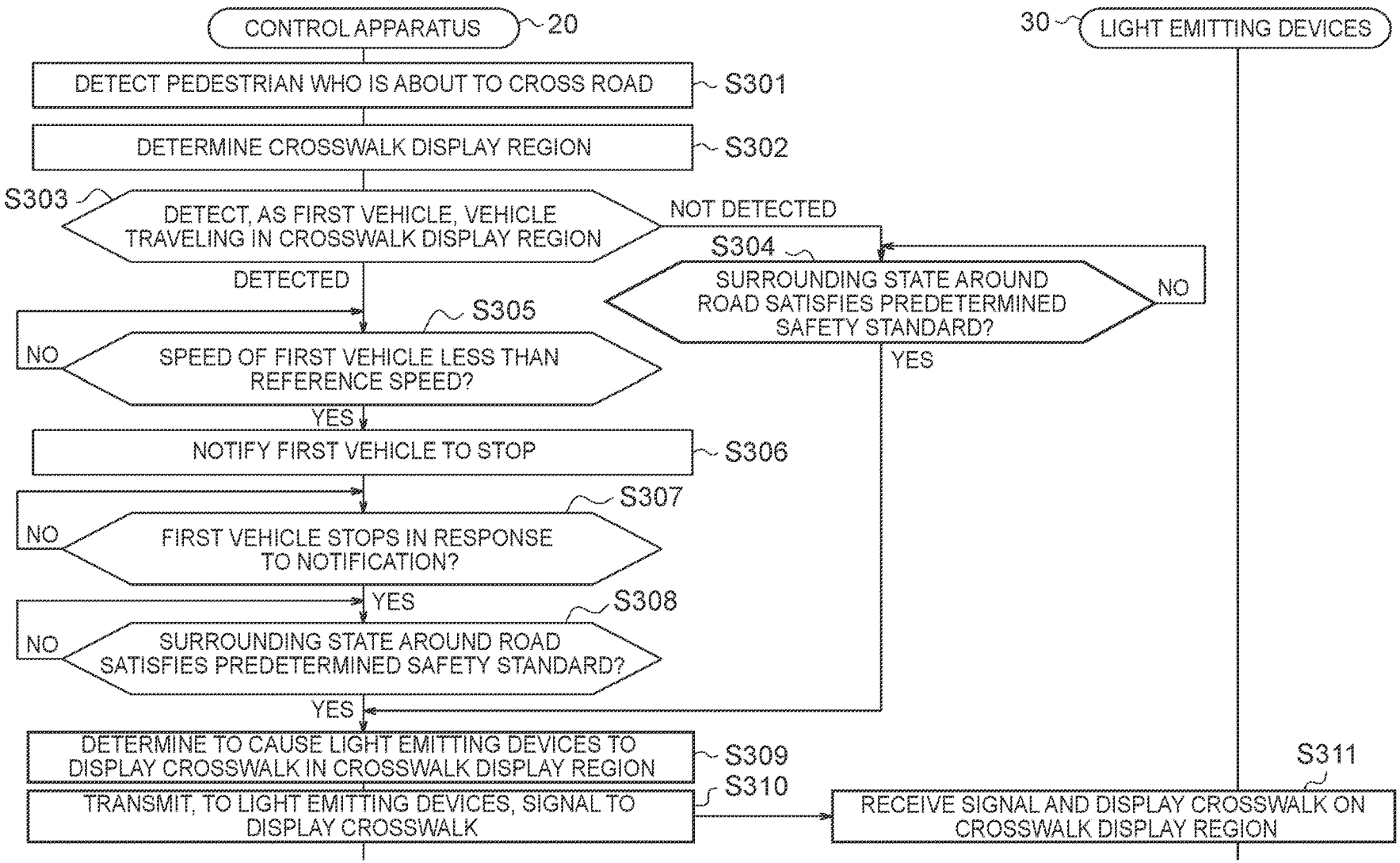
FIG. 7A is a view illustrating an operation of a system according to the second modification.

Steps S301 to S311 in FIG. 7A are similar to steps S101 to S111 in FIG. 3A according to the above embodiment and therefore are not described herein.

Figure 7B:
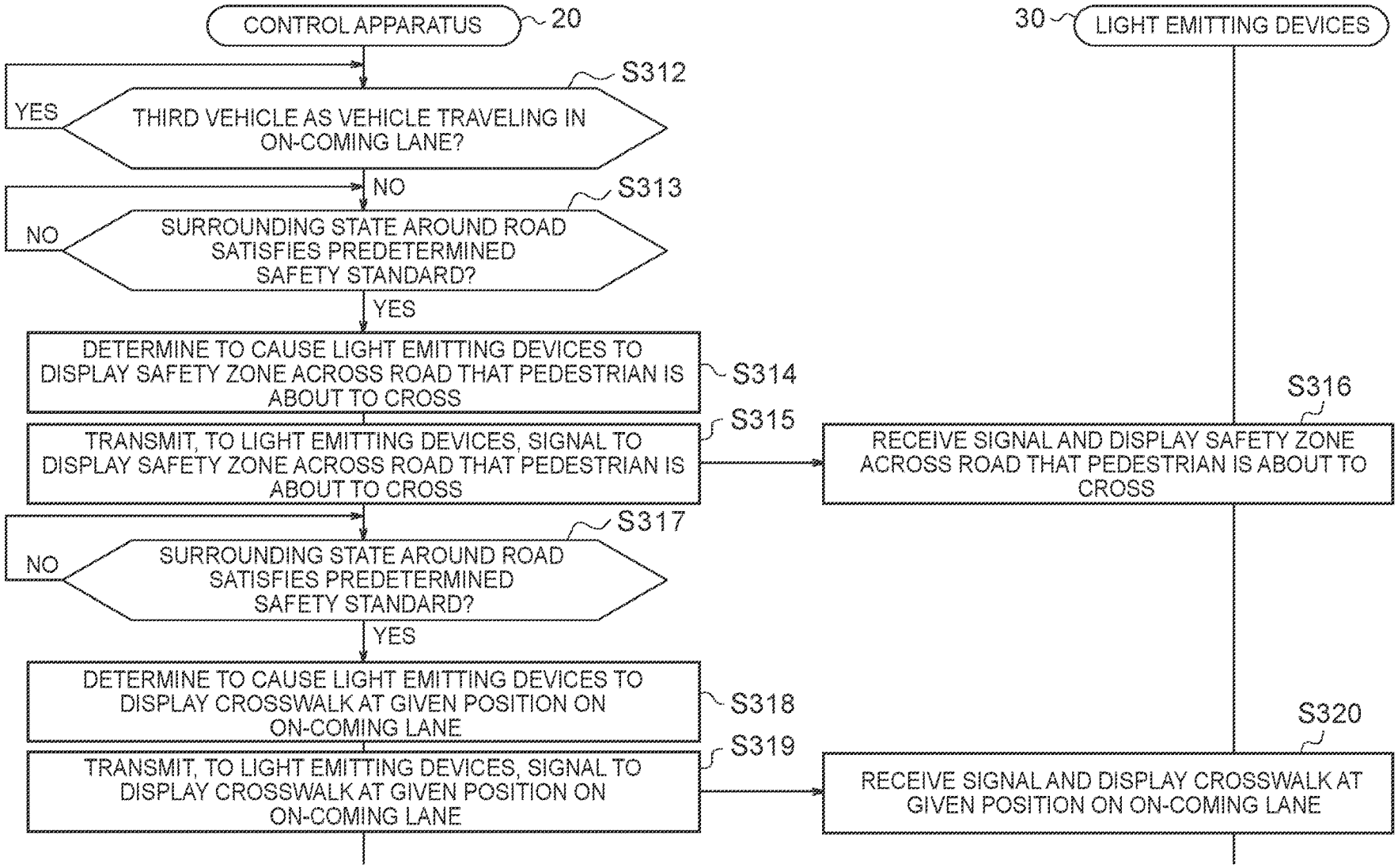
FIG. 7B is a view illustrating an operation of the system according to the second modification.

Step S312 and step S313 in FIG. 7B are similar to step S212 and step S213 in FIG. 5B according to the first modification and therefore are not described herein.

In step S314, the controlling portion 21 determines to cause the light emitting devices 30 to display a safety zone across the road that the pedestrian is to cross.

The controlling portion 21 selects one or more light emitting devices 30 to be controlled from among the light emitting devices 30 provided in the road. The selection of the light emitting devices 30 is performed based on the shape, the size, or the like of the safety zone to be displayed. Respective positions of the light emitting devices 30 may be stored in the storage portion 22 of the control apparatus 20 in advance.

In step S315, the controlling portion 21 transmits, to the light emitting devices 30, a signal to instruct the light emitting devices 30 to display the safety zone.

The controlling portion 21 transmits, to the one or more light emitting devices 30 selected in step S214 via the communication portion 23, a signal to instruct them to turn on the light emitting portions 34 of the one or more light emitting devices 30.

In step S316, the light emitting devices 30 receive the signal from the controlling portion 21 and display the safety zone across the road that the pedestrian is to cross.

The controlling portions 31 of the one or more light emitting devices 30 receive the signal from the control apparatus 20 via the communication portions 33 of the one or more light emitting devices 30 and turn on or blink the light emitting portions 34 of the one or more light emitting devices 30. Light emitted from the light emitting portions 34 forms the safety zone on the on-coming lane as a whole. The light emitting devices 30 can distinguishably display the safety zone on the on-coming lane by changing a planar pattern expressed by the light emitted from the light emitting portions 34, the color of the light, or the like.

Figure 6:
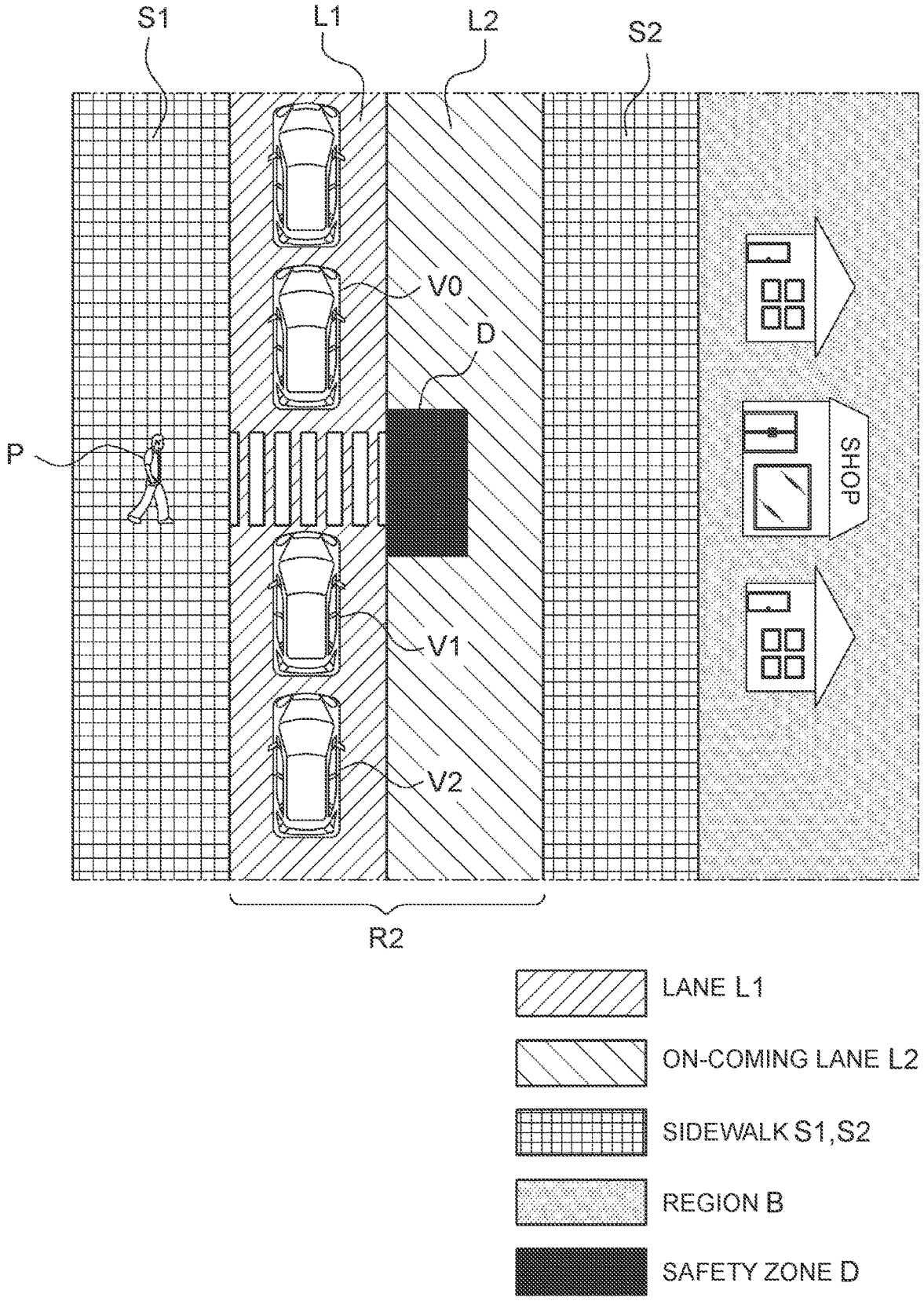
FIG. 6 is a view to describe a second modification.

FIG. 6 is a view illustrating a state where the light emitting devices 30 are controlled by the controlling portion 21, so that a safety zone D is displayed on the on-coming lane L2. At this time, the light emitting devices 30 may freshly display a short crosswalk. Hereby, the pedestrian P can move into a region only for pedestrians more quickly and safely than the case of FIG. 4A.

The processes from step S308 to step S311 in FIG. 7A may be performed at the same time as the processes from step S312 to step S316.

Processes from step S317 to step S320 in FIG. 7B are similar to the processes from steps S217 to step S220 in FIG. 5B according to the first modification and therefore are not described herein.

As described above, in the control apparatus 20 according to the present modification, in a case where the road includes an on-coming lane, the controlling portion 21 determines whether the third vehicle as a vehicle traveling in the on-coming lane is present or not. Then, in a case where the third vehicle is not present and the predetermined safety standard is satisfied, the controlling portion 21 determines to cause the light emitting devices 30 to display the safety zone across the road that the pedestrian is to cross.

In the present modification, in a case where no vehicle is present in the on-coming lane, the safety zone is displayed on the on-coming road under the condition that the predetermined safety standard is satisfied. Hereby, the distance of the crosswalk through which the pedestrian is to cross the road shortens, so that the pedestrian can reach a safe region only for pedestrians quickly. This makes it possible to improve convenience for the pedestrian and safety for the pedestrian during road crossing.

What is claimed is:

1. A control apparatus for causing light emitting devices to display a crosswalk when the control apparatus detects a pedestrian who is about to cross a road, the control apparatus comprising a controlling portion configured to:

detect, as a first vehicle, a vehicle traveling in a crosswalk display region where the crosswalk is to be displayed;

determine whether or not a speed of the first vehicle is less than a reference speed;

in a case where the speed is less than the reference speed and a predetermined safety standard is satisfied, determine to cause the light emitting devices to display the crosswalk;

in a case where the road includes an on-coming lane, the controlling portion determines whether a third vehicle traveling in the on-coming lane is present; and in a case where the third vehicle is not present and the predetermined safety standard is satisfied, the controlling portion is configured to cause the light emitting devices to display, in an exchanged manner, the on-coming lane and a sidewalk across the road that the pedestrian is about to cross.

2. The control apparatus according to claim 1, wherein, in a case where the controlling portion causes the light emitting devices to display the crosswalk, the controlling portion causes a roadside object of the road to display information indicating that the crosswalk is being displayed.

3. The control apparatus according to claim 1, wherein:

the controlling portion specifies, as a second vehicle, a vehicle following the first vehicle; and in a case where the control apparatus causes the light emitting devices to display the crosswalk, the controlling portion notifies the first vehicle and the second vehicle that the crosswalk is being displayed.

4. The control apparatus according to claim 3, wherein, the controlling portion notifies, via the light emitting devices, the first vehicle and the second vehicle that the crosswalk is being displayed.

5. The control apparatus according to claim 1, wherein:

in a case where the road includes an on-coming lane, the controlling portion determines whether a third vehicle as a vehicle traveling in the on-coming lane is present or not; and in a case where the third vehicle is not present and the predetermined safety standard is satisfied, the controlling portion determines to cause the light emitting devices to display a safety zone across the road that the pedestrian is about to cross.

6. The control apparatus according to claim 1, wherein the controlling portion determines, based on position information of the vehicle, whether or not the vehicle is traveling in the crosswalk display region.

7. The control apparatus according to claim 1, wherein the controlling portion determines whether or not the speed of the first vehicle is less than the reference speed, based on speed information acquired from the first vehicle.

8. A method to be executed by a control apparatus for causing light emitting devices to display a crosswalk when the control apparatus detects a pedestrian who is about to cross a road, the method comprising:

detecting, as a first vehicle, a vehicle traveling in a crosswalk display region where the crosswalk is to be displayed;

determining whether or not a speed of the first vehicle is less than a reference speed;

in a case where the speed is less than the reference speed and a predetermined safety standard is satisfied, determining to cause the light emitting devices to display the crosswalk;

in a case where the road includes an on-coming lane, determining whether a third vehicle in the on-coming lane is present; and in a case where the third vehicle is not present and the predetermined safety standard is satisfied, causing the light emitting devices to display, in an exchanged manner, the on-coming lane and a sidewalk across the road that the pedestrian is about to cross.

9. The method according to claim 8, further comprising, in a case where the light emitting devices are caused to display the crosswalk, causing a roadside object of the road to display information indicating that the crosswalk is being displayed.

10. The method according to claim 8, further comprising:

specifying, as a second vehicle, a vehicle following the first vehicle; and in a case where the light emitting devices are caused to display the crosswalk, notifying the first vehicle and the second vehicle that the crosswalk is being displayed.

11. The method according to claim 10, further comprising notifying, via the light emitting devices, the first vehicle and the second vehicle that the crosswalk is being displayed.

12. The method according to claim 8, further comprising:

in a case where the road includes an on-coming lane, determining whether a third vehicle as a vehicle traveling in the on-coming lane is present or not; and in a case where the third vehicle is not present and the predetermined safety standard is satisfied, determining to cause the light emitting devices to display a safety zone across the road that the pedestrian is about to cross.

* * * * *